United States Patent [19]

Held

[11] Patent Number: 4,467,718

[45] Date of Patent: Aug. 28, 1984

[54] PRESS BAND ARRANGEMENT FOR DOUBLE-BAND PRESSES

[76] Inventor: Kurt Held, Alte Str. 1, D-7218 Trossingen 2, Fed. Rep. of Germany

[21] Appl. No.: 398,319

[22] Filed: Jul. 15, 1982

[30] Foreign Application Priority Data

Aug. 6, 1981 [DE] Fed. Rep. of Germany ..... 3131150

[51] Int. Cl.[3] ..... B30B 5/06

[52] U.S. Cl. ..... 100/151; 198/817; 425/329

[58] Field of Search ..... 100/151, 152, 153, 154, 100/118, 119, 120; 425/329; 198/817

[56] References Cited

U.S. PATENT DOCUMENTS

| | | | |
|---|---|---|---|
| 1,302,142 | 4/1919 | Donovan | 100/151 |
| 2,554,988 | 5/1951 | Hollis | 100/151 |
| 2,682,216 | 6/1954 | Shields | 100/151 |
| 3,680,476 | 8/1972 | Pfeiffer | 100/151 |
| 3,850,093 | 11/1974 | Gersbeck | 100/151 |

*Primary Examiner*—Peter Feldman

*Attorney, Agent, or Firm*—Toren, McGeady and Stanger

[57] ABSTRACT

A press band arrangement for double-band presses for applying surface pressure on plate-shaped workpieces, continuously guided through such presses, are made up of single or multiple layer press bands. Each layer is formed by a number of individual, side-by-side, unconnected strips. In multiple layer press bands, the longitudinal edges of the strips in adjacent layers are offset relative to one another.

1 Claim, 2 Drawing Figures

PRESS BAND ARRANGEMENT FOR DOUBLE-BAND PRESSES

FIELD OF THE INVENTION

The invention relates to a press band arrangement for double-band presses for applying surface pressure on plate-shaped workpieces or on material webs continuously guided through such presses.

DESCRIPTION OF THE PRIOR ART

The bands which are usually made of suitable metals, particularly steel, singly or in several layers, closely adjacent, pushed into one another, are to transfer the pressure, which is generated by means of fluid pressure media or mechanically over an area to the material to be pressed, i.e. with or without forming a negative image of the press band surface on the material to be pressed, depending on the treatment purpose and the material to be pressed.

It is generally known to weld together such bands and band units of several longitudinally extending band strips according to the operating width of the machine if the band material is not available in the operating width of the machine. The longitudinal welding of steel bands is technically no problem, the removal of the tensile stresses which result in the welded seam due to shrinkage and which are added to the bending stresses and tensile stresses during normal operation and are therefore dangerous, requires an additional, difficult processing effort and is hardly possible to accomplish free of residual tension. An additional, expensive disadvantage, particularly in wide bands, consists in that a band or band unit which is damaged by a hard foreign body which entered the machine must be completely replaced.

SUMMARY OF THE INVENTION

It is the task of the invention to eliminate the above-described disadvantages and to suggest a method to decisively reduce the expenditure connected therewith.

The solution of this task is imparted by constructing the press bands as single or multiple layers with the layers made up of separate unconnected closely adjacent longitudinal strips extending over a pair of drums. Border disks on the drums hold the strips in place. In multiple layer press bands the edges of the strips in adjacent layers are offset.

DETAILED DESCRIPTION OF THE INVENTION

Figure 1:
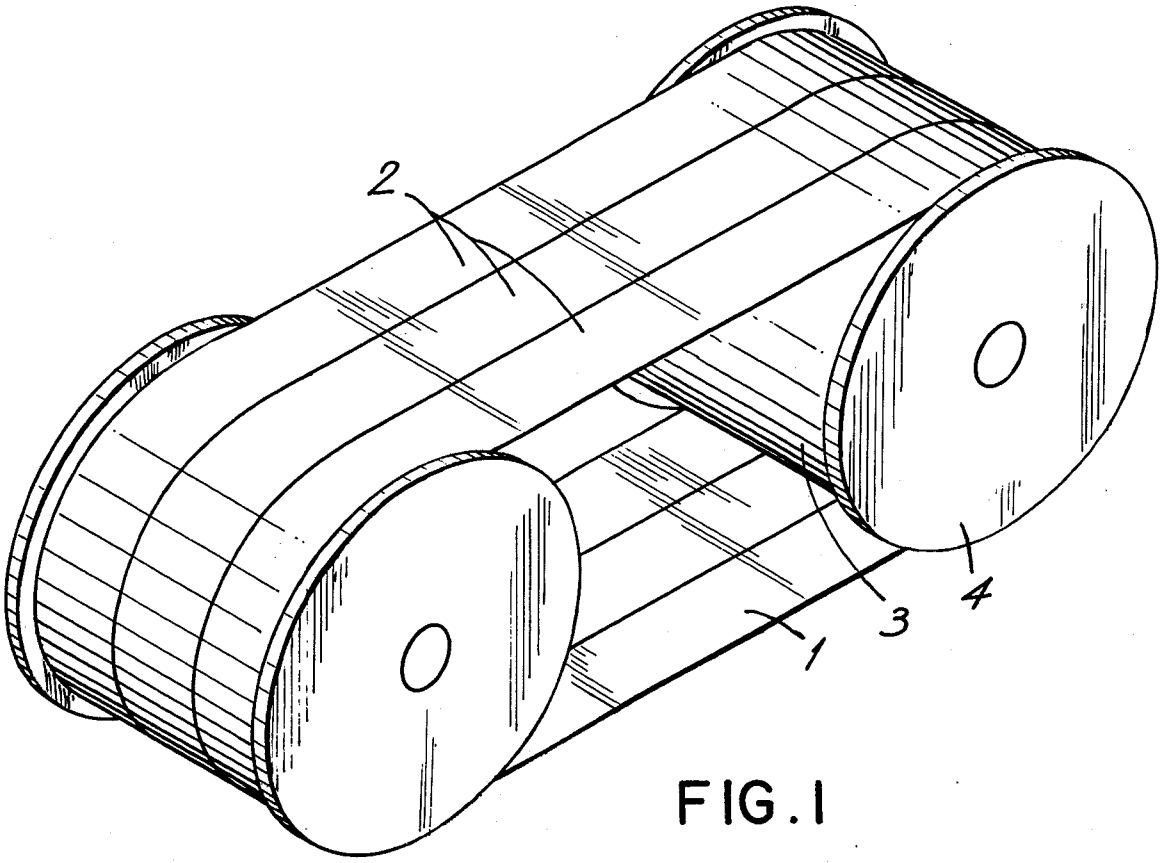
FIG. 1 is a perspective schematic view of a single layer press band embodying the present invention.
Figure 2:
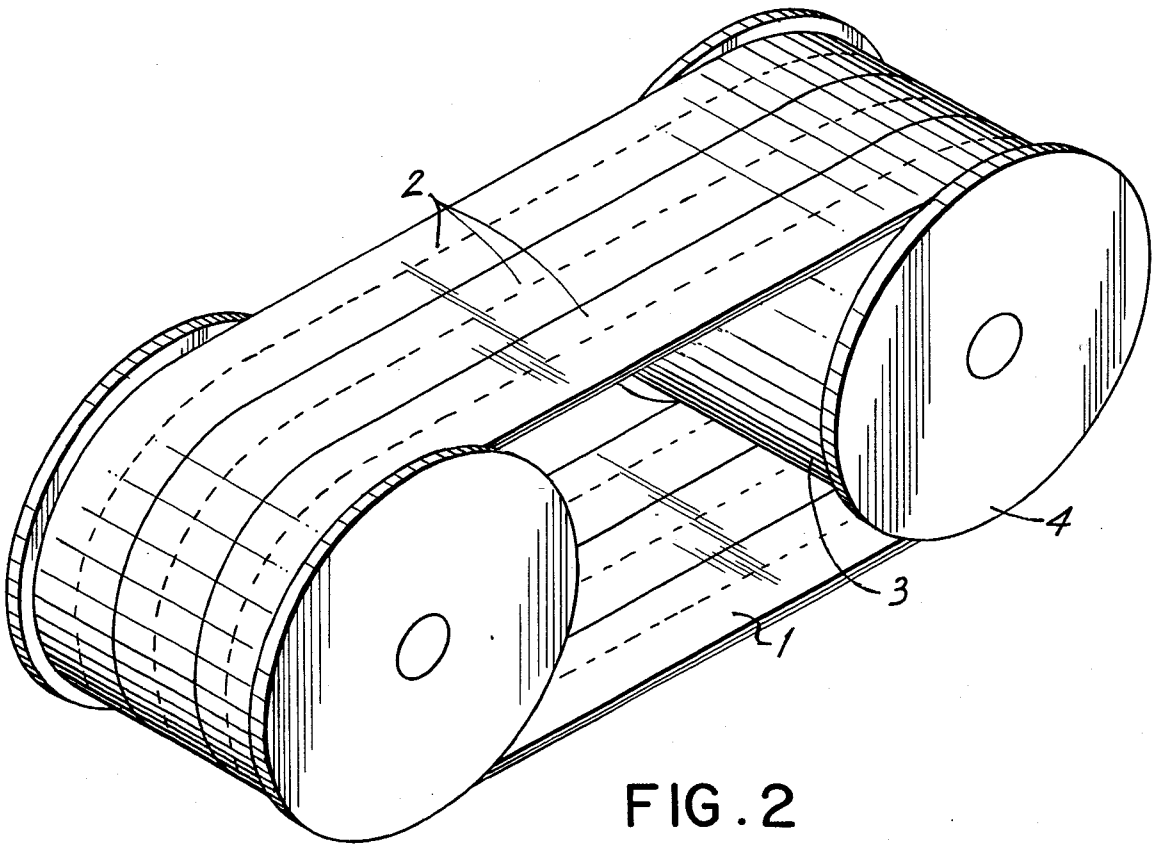
FIG. 2 is a view similar to FIG. 1 but illustrating a multiple layer press band.

As the drawing shows, the press bands 1 consist of individual, closely adjacent longitudinal strips which are not welded in the longitudinal direction, or of individual bands 2 of the same length which are arranged in a single layer (FIG. 1) or in several layers (FIG. 2) next to one another and are held by means of border disks 4 which are arranged at the sides of the band drums 3. Particularly in roller supported machines in which tightness with respect to a fluid pressure medium is not necessary, the arrangement according to the invention can be applied successfully. In multi-layered press band units as in FIG. 2, the units are pushed into one another in such a way that the longitudinal joints or edges of the individual band strips 2 are arranged offset with respect to one another in the transverse direction of the press band 1.

If, in the case of press band units, the operation or the use of the machine requires bands which are free of longitudinal gaps, i.e. which are, if necessary, longitudinally welded, then the remaining layers of the band unit may still be arranged unwelded if multi-layered press bands are required.

The advantages achieved with the invention are considerable because longitudinal welding and treatment of the longitudinally welded seam are omitted; when there are damages due to foreign bodies, replacements can be limited to the damaged parts or strips of a band layer; for the stock maintenance for replacement needs, it is sufficient to provide one individual band for each band layer and one longitudinal strip 2 for each band length.

I claim:

1. A press band arrangement for double-band presses for exercising a surface pressure on plate-shaped workpieces or on material webs which are continuously guided through such presses, comprising press bands (1) formed of multiple layers with each said layer comprising several individual, separate, closely adjacent longitudinal strips (2), a pair of drums (3) disposed in spaced relation with said multiple layers extending over and around said pair of drums, each said longitudinal strip having a pair of longitudinally extending laterally spaced edges, said edges of said longitudinally strips in adjacent said layers of said multiple layers being offset relative to one another transversely of the longitudinal direction of said strips, and border disks positioned at the opposite ends of said drums for holding said strips on said drums.

* * * * *